United States Patent [19]

Roth

[11] Patent Number: 4,519,231

[45] Date of Patent: May 28, 1985

[54] FORMING MACHINE INCLUDING DRIVE MECHANISM HAVING RACK AND GEAR SYNCHRONIZATION

[76] Inventor: Robert G. Roth, 17600 Collinson, East Detroit, Mich. 48021

[21] Appl. No.: 474,444

[22] Filed: Mar. 11, 1983

[51] Int. Cl.[3] ..... B21D 17/00

[52] U.S. Cl. ..... 72/88; 74/89.17; 74/409; 74/422

[58] Field of Search ..... 72/88, 90, 469, 449; 74/89.17, 409, 395, 422

[56] References Cited

U.S. PATENT DOCUMENTS

| | | | |
|---|---|---|---|
| 389,168 | 9/1888 | Rogers | 72/88 |
| 411,480 | 9/1889 | Warren | 72/88 |
| 2,930,877 | 3/1960 | Pelphrey | 72/88 |
| 2,995,964 | 8/1961 | Drader | 72/88 |
| 3,214,951 | 11/1965 | McCardell | 72/88 |
| 3,463,030 | 8/1969 | Nuccel | 74/409 |
| 3,572,158 | 3/1970 | Adams | 74/409 |
| 3,735,629 | 5/1973 | Paramonoff | 72/449 |
| 3,793,866 | 2/1974 | Anderson et al. | 72/88 |
| 4,080,699 | 3/1978 | Anderson | 72/88 |
| 4,155,236 | 5/1979 | Jungesjo | 72/88 |

FOREIGN PATENT DOCUMENTS

| | | | |
|---|---|---|---|
| 68143 | 5/1980 | Japan | 72/88 |
| 830500 | 3/1960 | United Kingdom | 72/88 |

*Primary Examiner*—Daniel C. Crane

*Attorney, Agent, or Firm*—Reising, Ethington, Barnard, Perry & Milton

[57] ABSTRACT

A forming machine (10) disclosed has an improved drive mechanism (28) for driving a pair of slides (20,22) mounted on upper and lower bases (12, 14) so as to provide forming of a workpiece for forming racks (24, 26) mounted on the slides. Upper and lower hydraulic motors (30,32) respectively drive the pair of slides whose movement is coordinated by a rotatable synchronizing gear (48) and upper and lower synchronizing racks (50,52). The synchronizing gear (48) is mounted by a connecting portion of the machine between the slides and is meshed with the synchronizing racks (50, 52) which are mounted on the slides by wedge adjusters (53) to adjust backlash of the synchronizing racks with the synchronizing gear. Both rotary and linear hydraulic motors for drivng the slides are disclosed. A pair of tie rod connections (150) preferably extend between the upper and lower bases to control deflection therebetween during the workpiece forming. Each tie rod connection (150) includes a sleeve (152) that is compressed and a tie rod (162) that extends through the sleeve and is tensioned in a preloaded manner to provide the prevention of deflection between the bases.

8 Claims, 4 Drawing Figures

FORMING MACHINE INCLUDING DRIVE MECHANISM HAVING RACK AND GEAR SYNCHRONIZATION

TECHNICAL FIELD

This invention relates to a forming machine which utilizes a pair of forming racks to form teeth or splines in a workpiece as the forming racks are moved rectilinearly in opposite directions as each other on opposite sides of the workpiece.

BACKGROUND ART

The type of forming machine which this invention relates to includes upper and lower bases and a rear connecting portion extending between the upper and lower bases to cooperate therewith in defining a work space. Upper and lower slides are respectively mounted on the upper and lower bases for rectilinear movement and are adapted to carry a pair of forming racks that form a workpiece during the slide movement so as to provide a round outer surface of the workpiece with teeth or splines.

U.S. Pat. No. 2,995,964 discloses a forming machine of the type involved with the invention wherein the slides on which the forming racks are mounted are moved by a pair of hydraulic cylinders to provide the forming. Adjustment of the forming racks on the slides to control the extent of workpiece forming is provided by wedge adjusters interposed between the forming racks and their associated slides. A pair of driving rack members are fixed to the slides in a spaced and substantial parallel relationship to each other and are meshed with a drive gear mounted for rotation with a spindle support utilized to mount the workpiece. Tie bars extend between the upper and lower bases to prevent deflection therebetween during the workpiece forming. In commercial units actually sold of this type of machine, the tie bars have merely been comprised of metallic straps having opposite ends that are respectively bolted to the upper and lower bases.

One problem with the type of machine disclosed by U.S. Pat. No. 2,995,964 discussed above is that the hydraulic cylinders are only capable of providing precise forming during their retraction strokes since there is a tendency of the cylinders to buckle during extension. As such, forming can only be performed during one direction of movement, i.e. during the retraction stroke. Another problem involved with this type of machine is that the metal straps utilized for the tie bars permit a certain amount of deflection due to the manner in which the straps are merely bolted to the bases.

U.S. Pat. No. 3,793,866, which is assigned to the assignee of the present invention, discloses a forming machine of the type to which this invention relates wherein a pair of rotary hydraulic motors are utilized to drive the slides on which the forming racks are mounted. Each rotary motor drives a shaft having a drive gear that is meshed with a drive rack mounted on the associated slide. The shafts also have associated synchronizing gears that are meshed with a common synchronizing gear in order to coordinate the movement of the pair of slides and hence the movement of the pair of forming racks. Adjustable deflection control connections extend between the upper and lower bases to control the deflection therebetween as the forming is performed on the workpiece by the forming racks upon slide movement under the impetus of the pair of rotary hydraulic motors.

While the machine disclosed by U.S. Pat. No. 3,793,866 discussed above illustrates spur gears for meshing and driving the drive racks mounted on the slides, commercial machies of this type have included a pair of helical gears of opposite angular orientation on each drive shaft and a pair of drive racks having angular teeth of opposite orientations on each slide. Such a dual gear and drive rack construction is required with each slide in order to carry both the driving forces and the synchronization forces without overloading the ends of the teeth and possibly causing one or more teeth to break off. Also, the synchronizing gears are located between the rotary hydraulic motors and the drive gears and are accommodated within support housings which must be sufficiently strong to withstand the torque applied by the rotary hydraulic motors that are mounted on the housings. Furthermore, eccentric supports must be provided to remove backlash from between the common synchronizing gear and the synchronizing gears on the shafts.

U.S. Pat. No. 4,155,236, which is also assigned to the assignee of the present invention, discloses a forming machine of the type to which the invention relates wherein equal displacement hydraulic cylinders are utilized to reciprocate forming racks in order to permit driving thereof by a closed loop hydraulic system. Deflection control connections that extend between upper and lower bases of the machine include sleeves having opposite ends engaged with the bases and also include bolts that extend between the bases through the sleeves in order to preload the sleeves in an adjustable manner to thereby control deflection between the bases as the forming is performed.

DISCLOSURE OF INVENTION

An object of the present invention is to provide an improved forming machine of the type including upper and lower bases, a connecting portion extending between the upper and lower bases to cooperate therewith in defining a work space, and upper and lower slides respectively mounted on the upper and lower bases for rectilinear movement and adapted to carry a pair of forming racks to form a workpiece therebetween during the movement of the slides.

In carrying out the above object, the machine includes an improved drive mechanism which utilizes upper and lower hydraulic motors respectively mounted on the upper and lower bases. The hydraulic motors are operable to respectively move the upper and lower slides in opposite directions in a parallel relationship to each other. A rotatable synchronizing gear is mounted by the connecting portion of the machine within the work space between the slides. A pair of synchronizing racks are respectively mounted by a pair of wedge adjusters on the upper and lower slides and are meshed with the synchronizing gear to synchronize the driving of the slides by the pair of motors. Each wedge adjuster includes a pair of wedges interposed between the associated slide and synchronizing rack. Relative movement between the wedges of each adjuster provides for adjustment of backlash between the associated synchronizing rack and the synchronizing gear.

In one preferred embodiment, the hydraulic motors are of the rotary type and each has an associated drive shaft driven thereby, with the drive shaft of the upper motor having a spur gear located above the upper slide, and with the drive shaft of the lower motor having a spur gear located below the lower slide. A pair of drive racks are respectively mounted on the upper and lower slides and have toothed faces respectively meshed with the spur gears on the drive shafts of the upper and lower rotary hydraulic motors to provide driving of the slides by the motors.

With the rotary motor embodiment of the forming machine, the drive racks on the slides can be driven by spur gears since the meshing thereof does not have to carry the synchronizing forces as is required with prior rotary drive mechanisms for this type of machine. Use of the spur gears allows each slide to be driven by a single drive rack since there are no lateral forces imparted thereto, as is the case with helical gears which require a pair of oppositely oriented helical gears and an associated pair of racks having angular teeth of opposite orientation for driving each slide. Also, the drive mechanism of the invention has a compact construction which does not require any auxiliary housings for mounting the rotary hydraulic motors as is the case with prior machines of this type having rotary drive mechanisms.

In the preferred construction of the rotary motor embodiment of the machine, the upper drive shaft has a pair of antifriction bearings for providing rotational support thereof on the upper base and the lower drive shaft has a pair of antifriction bearings for providing rotational support thereof on the lower base. The antifriction bearings of each pair are spaced from each other axially along the associated shaft with the associated spur gear located between the bearings. One antifriction bearing of each pair is preferably of the dual row tapered roller type so as to prevent axial movement of the shaft, while the other antifriction bearing of each pair is preferably of the needle roller type.

Another preferred embodiment of the machine includes hydraulic motors of the linear type embodied by cylinders that are extendable and retractable. Each cylinder has a connection to the associated slide to provide movement thereof during the extension and retraction of the cylinder. Preferably, each cylinder is fixed on the associated base and includes a piston connecting rod having an outer end at which the connection thereof to the associated slide is located.

A headstock of the forming machine rotatably supports the synchronizing gear and includes a workpiece support for rotatably supporting a workpiece between the forming racks for concentric rotation with the synchronizing gear.

Both embodiments of the forming machine also include a pair of tie rod connections extending between the upper and lower bases to control deflection therebetween during the workpiece forming. Each tie rod connection includes a sleeve having opposite ends respectively engaged with the upper and lower bases and also has a tie rod extending through the sleeve between the upper and lower bases. One end of the tie rod is secured to one of the bases, and the other end of the tie rod is secured by a threaded nut to the other base. Threading of the nut on the tie rod compresses the sleeve and tensions the tie rod in a preloaded manner to provide the prevention of deflection between the bases as the workpiece forming is performed.

The objects, features, and advantages of the present invention are readily apparent from the following detailed description of the best modes for carrying out the invention when taken in connection with the accompanying drawings.

BEST MODES FOR CARRYING OUT THE INVENTION

Figure 1:
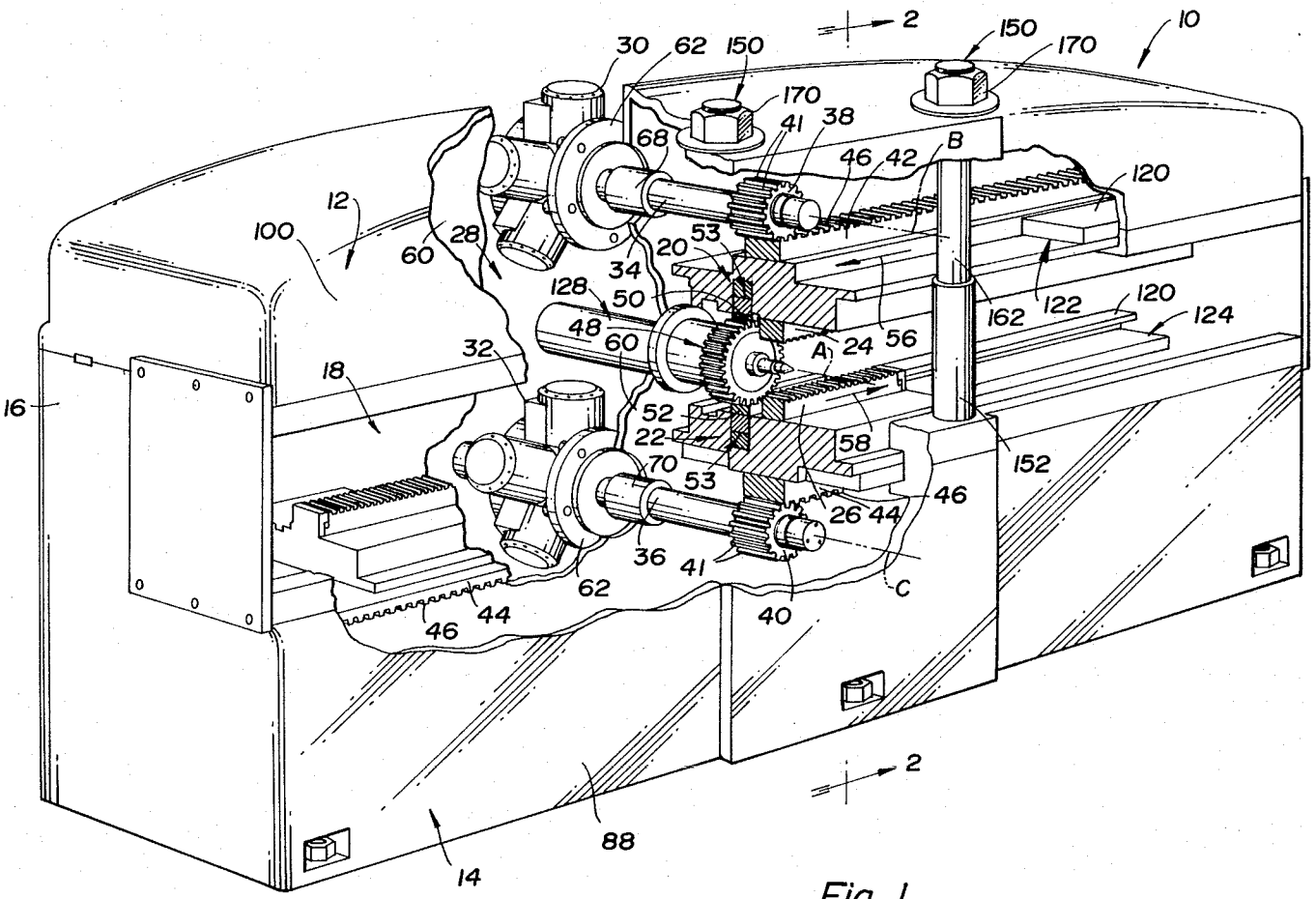
FIG. 1 is a partially broken away perspective view illustrating one embodiment of a forming machine constructed in accordance with the present invention.

Referring to FIG. 1 of the drawings, one embodiment of a forming machine constructed in accordance with the invention is generally indicated by reference numeral 10 and includes upper and lower bases 12 and 14 as well as a rear connecting portion 16 that extends between the bases to cooperate therewith in defining a work space 18. Upper and lower slides 20 and 22 are respectively mounted on the upper and lower bases 12 and 14 for rectilinear movement and are adapted to carry a pair of forming racks 24 and 26 to form a workpiece therebetween about a central axis A as is hereinafter more fully described.

An improved drive mechanism 28 of machine 10 is constructed in accordance with the present invention and include upper and lower rotary hydraulic motors 30 and 32 respectively mounted on the upper and lower bases 12 and 14. Upper and lower rotary hydraulic motors 30 and 32 have associated rotary drive shafts 34 and 36 which are rotatively driven thereby about upper and lower axes B and C during operation of the machine. Drive shaft 34 of the upper motor 30 has a spur gear 38 located above the upper slide 20, while the drive shaft 36 of the lower motor 32 has a spur gear 40 located below the lower slide 22. Output members in the form of spur gears 38 and 40 have teeth 41 that extend parallel to the associated axes of rotation B and C. Upper and lower drive racks 42 and 44 are respectively mounted on the upper and lower slides 20 and 22 and have toothed faces 46 whose teeth extend parallel to the rotational axes B and C and mesh with the spur gears 38 and 40 on the drive shafts 34 and 36 of the upper and lower rotary hydraulic motors 30 and 32 to provide driving of the slides by the motors.

A rotatable synchronizing gear 48 of the machine 10 illustrated in FIG. 1 is mounted for rotation about axis A by the connecting portion of the machine within the work space 18 between the upper and lower slides 20 and 22 just to the rear of the forming racks 24 and 26. A pair of upper and lower synchronizing racks 50 and 52 are respectively mounted on the upper and lower slides 20 and 22 and are meshed with the synchronizing gear 48 to synchronizing the driving of the slides by the pair of upper and lower hydraulic motors 30 and 32. Synchronizing racks 50 and 52 are respectively mounted on slides 20 and 22 by a pair of wedge adjusters 53. As is hereinafter more fully described in connection with FIG. 3, each wedge adjuster 53 includes a pair of wedges interposed between the associated slide and synchronizing rack. The pair of wedges of each wedge adjuster are movable with respect to each other to adjust the backlash between the associated synchronizing rack and the synchronizing gear.

Forming of a workpiece 54 (FIG. 2) begins with the upper and lower forming racks 24 and 26 positioned in an end-to-end relationship by the drive mechanism 28. Upon commencement of the forming operation, upper and lower rotary hydraulic motors 30 and 32 respectively drive the upper and lower slides 20 and 22 in opposite directions as each other as illustrated by arrows 56 and 58 in FIG. 1. Such movement engages the forming racks 24 and 26 with a round outer surface of the workpiece to pressure form teeth or splines therein as the workpiece rotates about the central axis A. During such forming, the synchronizing gear 48 and the synchronizing racks 50 and 52 synchronize the movement of the upper and lower slides 20 and 22 with respect to each other to provide precise forming of the teeth or splines on the workpiece. Spur gears 38 and 40 and the drive racks 42 and 44 transmit only the driving force required to move the slides 20 and 22 since the synchronizing connection therebetween is carried by the synchronizing gear 48 and the synchronizing racks 50 and 52. Spur gears 38 and 40 and the toothed forming faces 46 on the upper and lower drive racks 42 and 44 can be utilized with teeth parallel to the rotational axes B and C because the synchronizing torque is not carried thereby so as to necessitate use of a pair of oppositely oriented helical gears and an associated pair of racks on each of the slides as is necessary with prior art machines of the type involved driven by rotary hydraulic motors.

Figure 2:
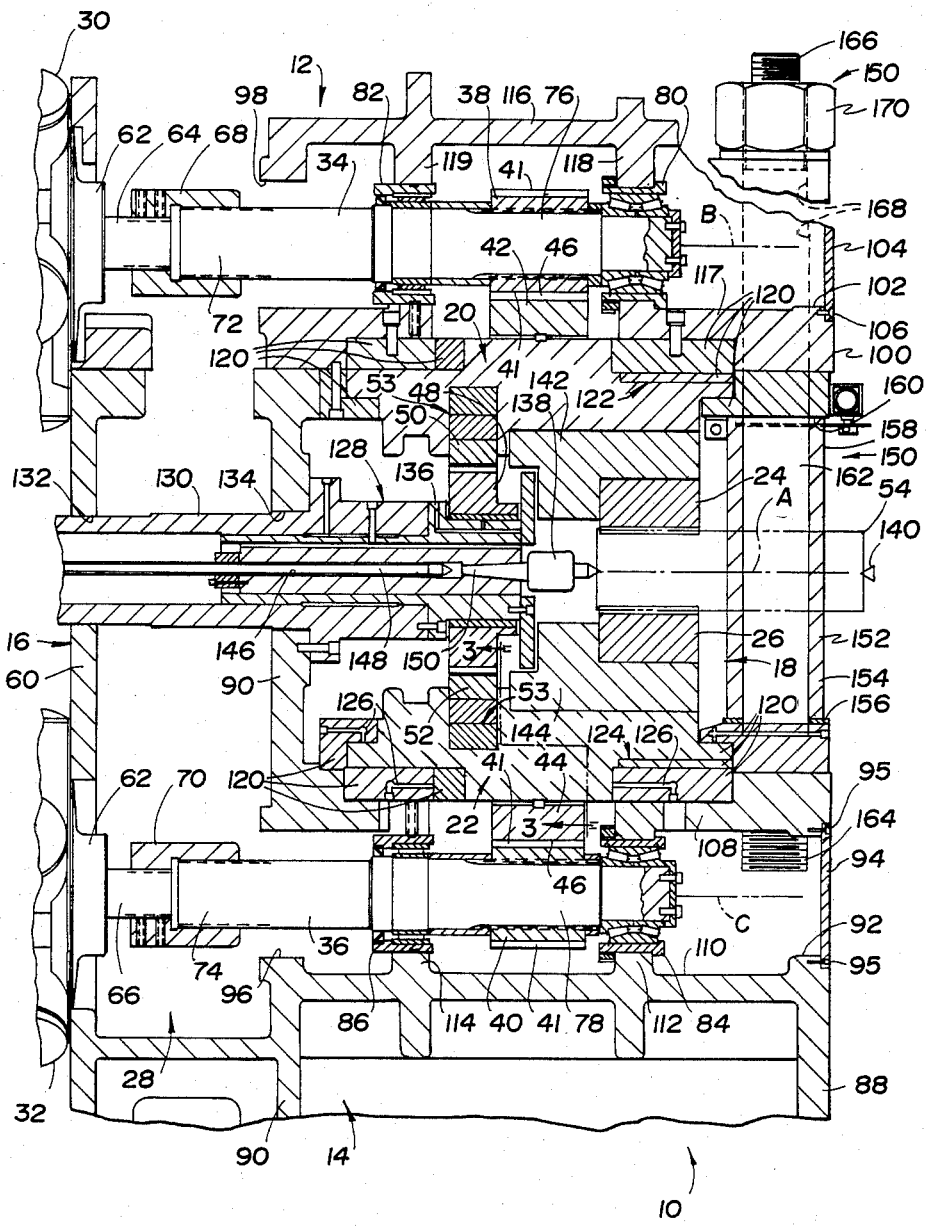
FIG. 2 is a sectional view taken through the forming machine along the direction of line 2—2 in FIG. 1.

As seen in both FIGS. 1 and 2 of the drawings, a rear wall 60 of the machine 10 extends from the upper base 12 past the connecting portion 16 to the lower base 14. Upper and lower rotary hydraulic motors 30 and 32 have mounting plates 62 which are mounted on the rear wall 60 at the upper and lower bases 12 and 14 above and below the axis A about which the workpiece rotates during the forming operation.

Referring to FIG. 2, the upper and lower rotary hydraulic motors 30 and 32 have associated output shafts 64 and 66 which are respectively connected to upper and lower couplings 68 and 70. Rear ends 72 and 74 of the drive shafts 36 and 38 are respectively connected to the upper and lower couplings 68 and 70 so as to be rotatively driven by the upper and lower rotary hydraulic motors through the couplings. Upper and lower drive shafts 34 and 36 also have associated front ends 76 and 78 on which the spur gears 38 and 40 are mounted. The upper drive shaft 34 has a pair of antifriction bearings 80 and 82 for providing rotational support thereof on the upper base 12, while the lower drive shaft 36 has a pair of antifriction bearings 84 and 86 for providing rotational support thereof on the lower base 14. The antifriction bearings 80, 82 and 84, 86 of each pair are spaced from each other axially along the associated shafts 34 and 36 with the spur gears 38 and 40 located between the bearings so as to be accurately supported for rotation about axes B and C. One of the antifriction bearings 80, 84 of each pair is of the dual row tapered roller type so as to prevent axial movement of the associated drive shaft 34, 36 during operation of the machine, while the other antifriction bearings 82, 86 of each pair is of the needle roller type.

As seen in FIG. 2, the lower base 14 of machine 10 has a front wall 88 and an intermediate wall 90 located adjacent the rear wall 60. Front wall 88 of the machine has an opening 92 aligned with the lower drive shaft 36 and is closed by an access plate 94 which is removably secured in position by screws 95. Removal of the access plate 94 provides access to the lower drive shaft 36 for assembly and disassembly as may be required for maintenance and/or repair. Intermediate wall 90 has a lower opening 96 through which the lower drive shaft 36 extends, and intermediate wall 90 extends upwardly to define an upper opening 98 through which the upper drive shaft 34 extends. A front wall 100 of the upper base 12 has an opening 102 which is closed by a removable access plate 104 secured by bolts 106 so as to thereby selectively permit access to the upper drive shaft 34 for assembly or disassembly as may be required for maintenance and/or repair.

With continuing reference to FIG. 2, the lower base 14 has upper and lower walls 108 and 110 that connect the front and rear walls 88 and 90. Front and rear bosses 112 and 114 extend between the upper and lower walls 108 and 110 and define openings that receive the pair of antifriction bearings 84 and 86 by which the lower shaft 36 is rotatively supported. Upper base 12 also has upper and lower walls 116 and 117 connecting its front wall 100 and the intermediate wall 90. Front and rear bosses 118 and 119 extend between the upper and lower walls 108 and 110 and define openings that receive the antifriction bearings 80 and 82 by which the upper drive shaft 34 is rotatively supported.

Referring to FIG. 2, upper and lower bases 12 and 14 include slideway members 120 that cooperate with the lower wall 117 on the upper base 12 and with the upper wall 108 on the lower base 14 to provide upper and lower slideways 122 and 124 on which the upper and lower slides 20 and 22 are respectively slidably mounted. Suitable lubrication ports 126 in the lower slideway members 120 provide for lubrication of the interengaged sliding surfaces between the lower slide 22 and the lower slideway 124.

As illustrated in FIG. 2, machine 10 includes a headstock 128 having a tubular housing 130 extending through openings 132 and 134 in the rear wall 60 and the intermediate wall 90 of the machine. At its front end, the headstock 128 includes an adapter assembly 136 that rotatably mounts the synchronizing gear 48. Headstock 128 also includes a workpiece support 138 that cooperates with a schematically illustrated workpiece support 140 of an unshown tailstock to rotatably mount the workpiece 54 for rotation about axis A during the forming operation. The upper and lower forming racks 24 and 26 which perform the forming are mounted on the upper and lower slides 20 and 22 by rack boxes 142 and 144 located just above and below the workpiece support 138. Adapter assembly 136 of the headstock 128 has a central opening 146 through which a rod 148 extends such that axial movement of the rod in a forward direction provides engagement thereof with a tapered mounting shank 150 of workpiece support 138 in order to permit removal thereof for replacement or repair.

As seen in FIG. 1, forming machine 10 includes a pair of tie rod connections 150 that extend between the upper and lower bases 12 and 14 to control deflection therebetween during the forming operation. Each tie rod connection has a construction as illustrated in FIG. 2 including a sleeve 152 whose lower end 154 is engaged with an upwardly facing surface 156 on the lower base 14 and whose upper end 158 is engaged with a downwardly facing surface 160 on the upper base 12. A tie rod 162 of each connection 150 extends through the sleeve 152 thereof between the upper and lower bases. Each tie rod 162 has a threaded lower end 164 that is threaded into an associated threaded hole in the lower base 14. A threaded upper end 166 of each tie rod 162 extends through a hole 168 in the upper base 12 and receives a nut 170. Torquing of the nut 170 onto the upper tie rod end 166 compresses the sleeve 152 and tensions the tie rod 162 in a preloaded manner to provide the prevention of deflection between the bases as the forming operation is performed.

Figure 3:
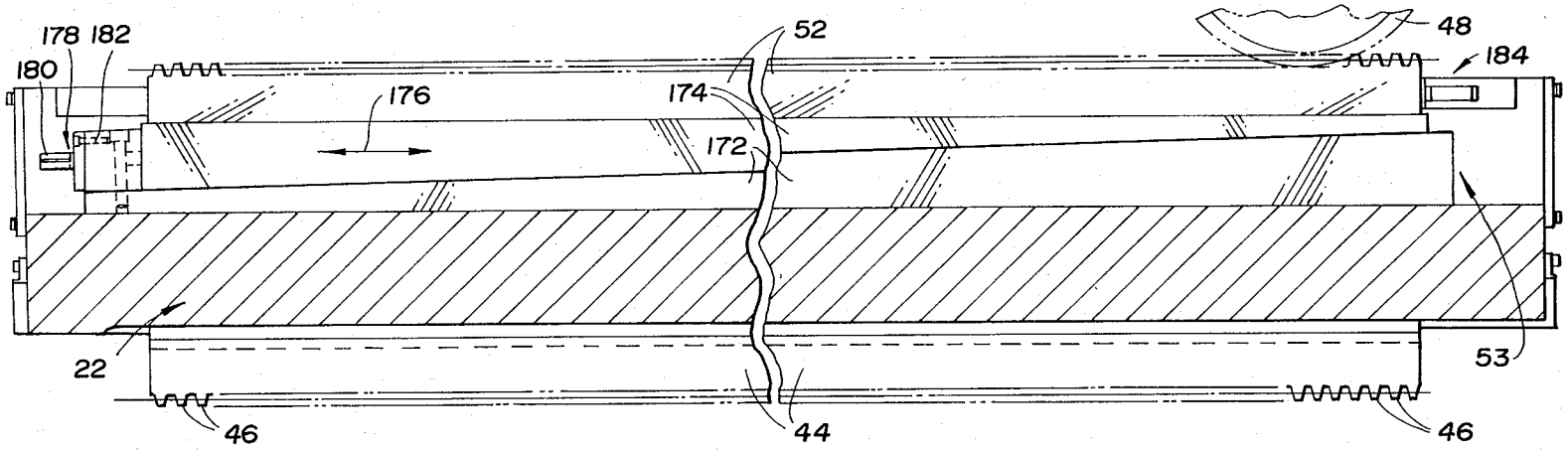
FIG. 3 is a sectional view taken along the direction of line 3—3 in FIG. 2 to illustrate the construction of wedge adjusters utilized to adjust backlash between a synchronizing gear and synchronizing racks of the machine.

As illustrated by the lower wedge adjuster 53 shown in FIG. 3, each wedge adjuster includes a pair of wedges 172 and 174 interposed between the associated slide and synchronizing rack. One of the wedges 172 is fixed to the lower slide 22 in any suitable manner such as by threaded bolts which are not shown. The other wedge is located between the fixed wedge 172 and the lower synchronizing rack 52 and is movable longitudinally with respect to the fixed wedge as shown by arrows 176 to adjust the vertical position of the synchronizing rack. Such vertical adjustment of the lower synchronizing rack 52 adjusts the backlash thereof with the synchronizing gear 48. The wedge adjuster 53 associated with the upper slide likewise provides for adjustment of the backlash between the upper synchronizing rack and the synchronizing gear 48.

Longitudinal adjustment of the movable wedge 174 of the lower wedge adjuster 53 shown in FIG. 3 is provided by a threaded bolt positioner 178 located at the left end of the fixed wedge 172. Threaded adjustment of a bolt 180 of positioner 178 within a threaded block 182 mounted on the fixed wedge 172 provides the movement of wedge 174 toward the left or right. Suitable bolt and slot connections which are not shown secure the lower synchronizing 52 with respect to the fixed wedge 172 and the slide 22 while allowing the longitudinal adjusting movement of wedge 174. A suitable adjustment mechanism 184 engages the right end of the lower synchronizing rack 184 to adjust the longitudinal position thereof before securement thereof by the associated connections in a fixed position with respect to the lower slide 22.

Figure 4:
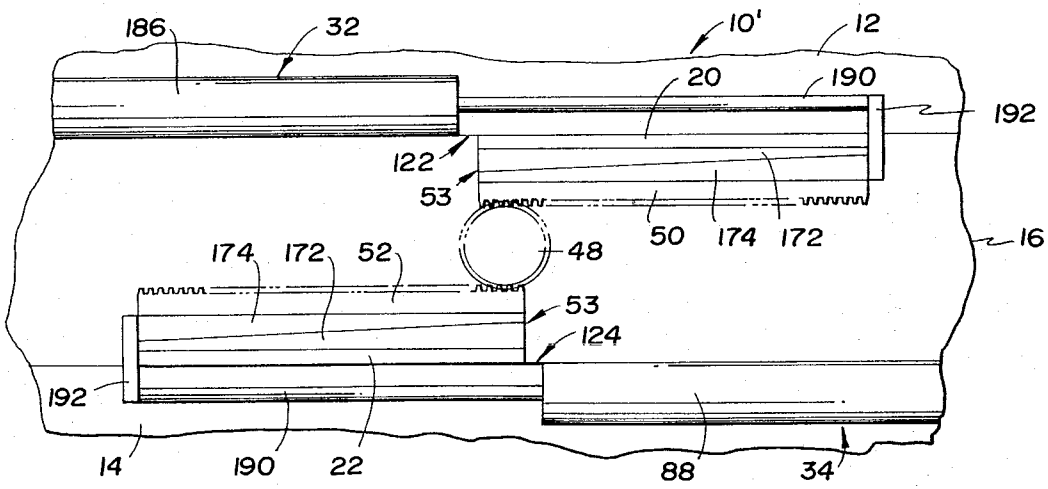
FIG. 4 is a schematic view illustrating another embodiment of a forming machine constructed in accordance with the invention.

With reference to FIG. 4, another embodiment of a machine constructed in accordance with the invention is indicated generally by 10' and has the same construction as the previously described except for the differences discussed. As such, like reference numerals are applied to the like components thereof and much of the previous description is applicable such that no repetition thereof is necessary.

Machine 10' shown in FIG. 4 includes upper and lower hydraulic motors 32 and 34 which are of the linear type and embodied by cylinders 186 and 188. These hydraulic cylinders 186 and 188 are respectively mounted on the upper and lower bases 12 and 14 and are extendable and retractable to move the slides 20 and 22 in order to provide forming of a workpiece as previously discussed. Each cylinder 186 and 188 includes a piston connecting rod 190 whose outer end has an output member in the form of a connection 192 to the associated slide 20 or 22. Workpiece forming is provided during the retracting stroke as the piston connecting rods are drawn into the cylinders 186 and 188. Thereafter, extending movement of the cylinders 186 and 188 moves the piston connecting rods 190 outwardly to move the slides 20 and 22 back to their original positions in preparation for the next cycle.

Wedge adjusters 53 of machine 10' shown in FIG. 4 adjust backlash between the upper and lower synchronizing racks 50 and 52 and the synchronizing gear 48 in the same manner previously described. Likewise, tie rod connections extend between the machine bases to limit deflection therebetween during workpiece forming.

While the best modes for carrying out the invention has been described in detail, those familiar with the art to which the invention relates will recognize various alternatives designs and embodiments for practicing the invention as defined by the following claims.

What is claimed is:

1. In a forming machine including upper and lower bases (12, 14), a connecting portion (16) extending between the upper and lower bases to cooperate therewith in defining a work space (18), said upper base having a front wall (100), said lower base having a front wall (88), and said machine having a rear wall (60) common to the upper and lower bases and connecting portion; an intermediate wall (90) spaced rearwardly from said front walls (88, 100) and forwardly of said rear wall (60) defining the front vertical wall of said connecting portion; and upper and lower slides (20, 22) respectively mounted on the upper and lower bases for rectilinear movement, the improvement comprising: said upper base (12) having a pair of vertically spaced, horizontal upper and lower walls (116, 117) extending rearwardly from said front wall (100) above said work space; a pair of horizontally spaced vertical front and rear bosses (118, 119) extending between the upper and lower walls (116, 117) of the upper base (12); said lower base (14) having a pair of horizontal, vertically spaced, upper and lower walls (108, 110) extending rearwardly from said front wall (88) beneath said work space; a pair of vertical, horizontally spaced front and rear bosses (112, 114) extending between the upper and lower walls (108, 110) of the lower base (14); said front and rear bosses (118, 119) of said upper base (12) being in substantially co-planar relationship with the front and rear bosses (112, 114), respectively, of the lower base (14); said intermediate wall (90) being spaced from said rear bosses (114) and (119) on the sides thereof opposite the front bosses (112, 118) and extending between the lower wall (117) of the upper base (12) and the upper wall (108) of the lower base (14); aligned openings (134) in said rear and intermediate walls (60, 90); a headstock (128) projecting into the work space (18) and having a tubular housing (130) supported in said openings (132, 134); upper and lower slides (20, 22) mounted respectively on the lower wall (117) of said upper base (12) and the upper wall (108) of said lower base (14); upper and lower synchronizing racks (50, 52) mounted respectively on said upper and lower slides (20, 22); a synchronizing gear (48) lying in a plane and rotatably mounted on said headstock housing (130) in meshed engagement with said synchronizing racks (50, 52); and a pair of opposed, upper and lower forming racks (24, 26) mounted respectively on said upper and lower slides (20, 22) on the opposite side of said synchronizing racks (50, 52) from said intermediate wall (90); whereby said slides and forming racks are rectilinearly moveable in opposite directions in synchronized relationship; upper and lower hydraulic motors (30, 32) respectively mounted on the upper and lower bases operable to respectively move the upper and lower slides in opposite directions in parallel relationship to each other, said upper hydraulic motor having an output member (38, 192) connected with said upper slide in the space enclosed by said front and rear bosses (118, 119) and upper and lower walls (116, 117) of said upper base and forwardly of the plane of said synchronizing gear (48); said lower hydraulic motor having an output member (38, 192) connected with said lower slide in the space enclosed by said front and rear bosses (112, 114) and upper and lower walls (108, 110) of said lower base and forwardly of the plane of said synchronizing gear (48) so that said hydraulic motors apply forces on said slides to cause reciprocation thereof on the opposite side of said synchronizing gear from said intermediate wall; a pair of tie rod connections extending between the upper and lower bases to control deflection therebetween, each tie rod connection including a sleeve having opposite ends respectively engaged with the upper and lower bases, and each tie rod connection also having a tie rod extending through the sleeve thereof between the upper and lower bases and including a nut threaded thereto for compressing the sleeve and tensioning the tie rod in a preloaded manner to provide the prevention of deflection between the bases.

2. A forming machine as claimed in claim 1 wherein each hydraulic motor (30, 32) is of the rotary type and includes a drive shaft driven thereby, said output members comprising a spur gear (38) on said drive shaft (34) located above the upper slide; and a spur gear (38) on said drive shaft (36) located below the lower slide, and a pair of drive racks (42, 44) respectively mounted on the upper and lower slides (20, 22) and having toothed faces respectively meshed with the spur gears (38) on the drive shafts (34, 36) of the upper and lower rotary hydraulic motors (30, 32) to provide driving of the slides by the motors.

3. A forming machine as claimed in claim 2 wherein the upper drive shaft has a pair of antifriction bearings for providing rotational support thereof on the upper base, the lower drive shaft having a pair of antifriction bearings for providing rotational support thereof on the lower base, and the antifriction bearings of each pair being spaced from each other axially along the associated shaft with the associated spur gear located between the bearings.

4. A forming machine as claimed in claim 3 wherein one antifriction bearing of each pair is of the dual row tapered roller type so as to prevent axial movement of the shaft, and wherein the other antifriction bearing of each pair is of the needle roller type.

5. A forming machine as claimed in claim 1 wherein each hydraulic motor is of the linear type comprising a cylinder that is extendable and retractable, said output member comprising a connection (192) to the associated slide to provide movement thereof during the extension and retraction of the cylinder.

6. A forming machine as claimed in claim 5 wherein each cylinder includes a piston connecting rod having an outer end at which the connection thereof to the associate slide is located.

7. A forming machine as claimed in claims 1, 2 or 5 further including a pair of wedge adjusters that respectively mount the pair of synchronizing racks on the upper and lower slides in meshing relationship with the synchronizing gear to synchronize the driving of the slides by the pair of motors; and each wedge adjuster including a pair of wedges which are interposed between the associated slide and synchronizing rack and which are movable with respect to each other to adjust the backlash between the associated synchronizing rack and the synchronizing gear.

8. A forming machine as claimed in claims 1, 2 or 5 wherein said headstock (128) includes a workpiece support (138) for rotatably supporting a workpiece between the forming racks for concentric rotation with the synchronizing gear.

* * * * *